United States Patent [19]

Takahashi et al.

[11] Patent Number: 4,676,146

[45] Date of Patent: Jun. 30, 1987

[54] FIN SWINGING ANGLE CONTROL APPARATUS

[75] Inventors: Akira Takahashi; Kuniya Kamioka, both of Kawasaki, Japan

[73] Assignee: Jeco Co., Kanagawa, Japan

[21] Appl. No.: 757,599

[22] Filed: Jul. 22, 1985

[30] Foreign Application Priority Data

Jul. 23, 1984 [JP] Japan ..... 59-111513

[51] Int. Cl.[4] ..... F24F 13/15

[52] U.S. Cl. ..... 98/40.3; 98/2; 98/2.01

[58] Field of Search ..... 98/2, 2.01, 40.3, 94.2, 98/110, 121.2; 415/125

[56] References Cited

U.S. PATENT DOCUMENTS

| | | | |
|---|---|---|---|
| 3,330,202 | 7/1967 | Colle | 98/40.3 |
| 4,339,991 | 7/1982 | Asano et al. | 98/2 X |

FOREIGN PATENT DOCUMENTS

| | | | |
|---|---|---|---|
| 27793 | 7/1973 | Japan | 98/40.3 |
| 49513 | 3/1983 | Japan | 98/2.01 |
| 2108263 | 5/1983 | United Kingdom | 98/40.3 |

*Primary Examiner*—Harold Joyce

*Attorney, Agent, or Firm*—Townsend & Townsend

[57] ABSTRACT

The swinging angle of fins of an air conditioner or the like is controlled by control apparatus including a fin driver for swinging the fin about a pivot thereof, fin swinging angle adjusting means and an adjusting mechanism for adjusting the center of the swinging angle of the fin.

6 Claims, 11 Drawing Figures

FIN SWINGING ANGLE CONTROL APPARATUS

BACKGROUND OF THE INVENTION

This invention relates to a fin swinging angle control apparatus, and more particulary fin swinging angle control apparatus of an air conditioner, for example.

In a prior art air conditioner of a car, a motor operated louver has been used which adjusts the direction of cool air or warm air discharged from an air discharge port. According to a conventional motor operated louver, air sent from a blower is ejected through an opening of a housing installed in a car and a plurality of parallel fins are mounted in the opening to be periodically swung over a definite angle by a link mechanism connected to a motor shaft. In such motor operated louver, it is not only impossible to vary the swinging angle of the fins but also to change the center of swinging angle so that it is impossible to increase cooling or warming effectiveness only at a required direction, for example only toward the driver of the car. Only measure is to increase the rotation speed of the motor so as to shorten the period of swinging of the fins for increasing the frequency of air blast toward the driver.

However, at the time of long distance running, when the sun continuously shines on a driver's seat, especially when an assistant driver's seat is not occupied by other person, it is efficient to concentrate ejected cool air to the driver's seat causing the driver to be more confortable. Even when a plurality of persons ride in the car it is desirable to supply much more quantity of cool air to windows on the side of the sun.

To this end it is necessary to set the swinging angle and the center of the swinging angle of the fins of the motor operated louver to any values, but such a convenient motor operated louver has not been proposed.

SUMMARY OF THE INVENTION

Accordingly, it is an object of this invention to provide fin swinging angle control apparatus capable of supplying cool air or warm air in an optimum direction and width in accordance with the condition in a car.

According to this invention there is provided fin swinging angle control apparatus comprising a fin rotatably pivoted on a shaft, fin driving means for continuously swinging the fin about the shaft, fin swinging angle adjusting means for adjusting the swinging angle of the fin, and fin swinging angle center adjusting means for adjusting the center of the fin swinging angle.

DESCRIPTION OF THE PREFERRED EMBODIMENTS

Figure 1:
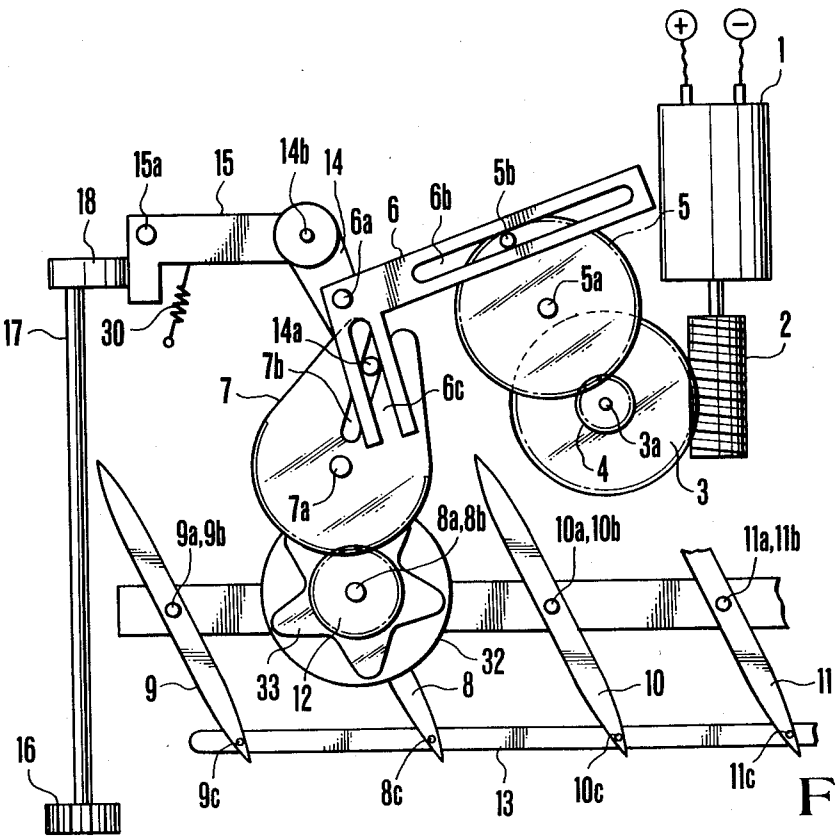
FIG. 1 is a plan view of one embodiment of the apparatus according to this invention.
Figure 2:
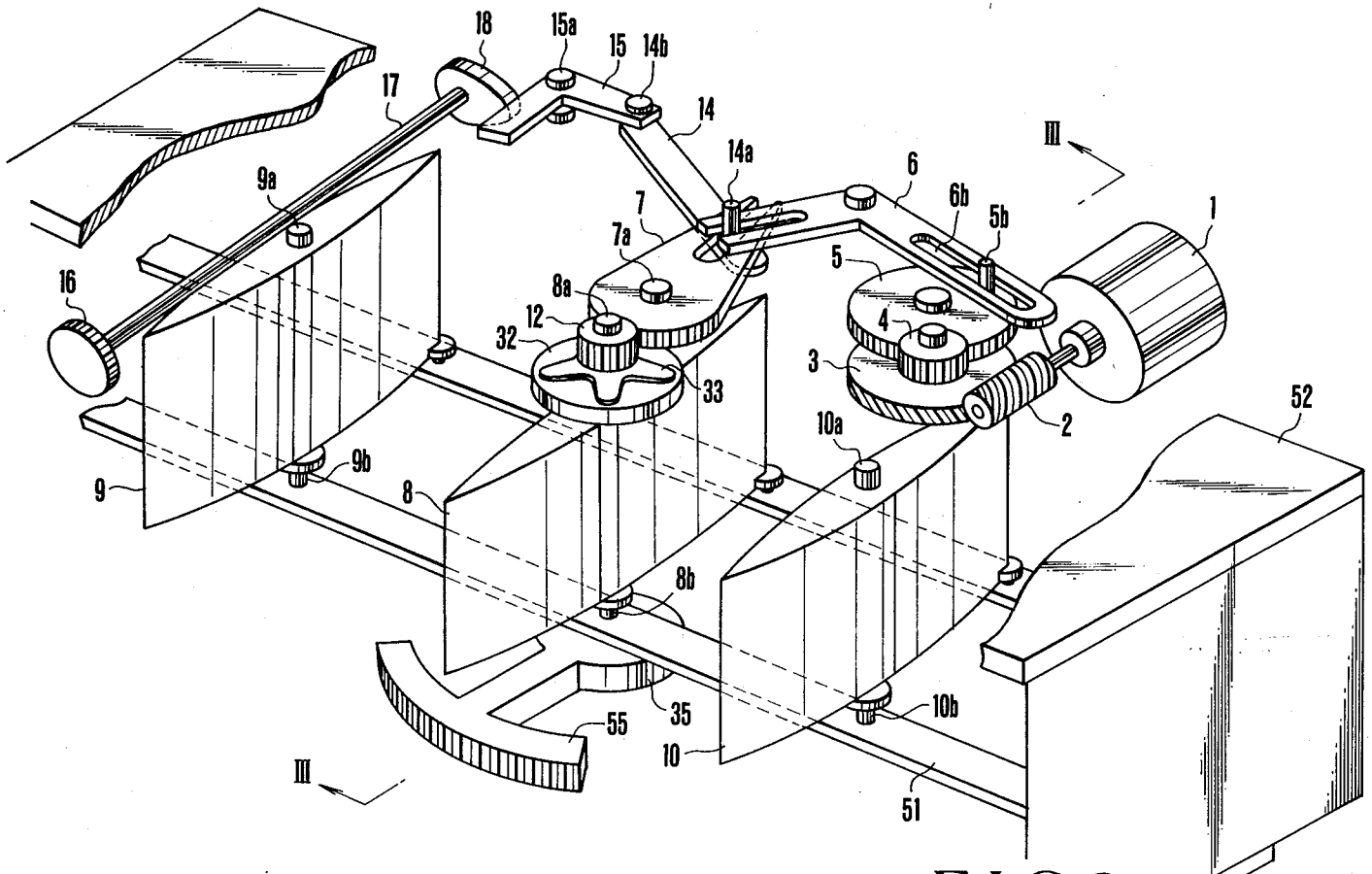
FIG. 2 is a perspective view of the apparatus, with a portion cut away.

A preferred embodiment of this invention shown in FIGS. 1 and 2 comprises an electric motor 1 which drives a reduction gear 4 mounted on a stationary shaft 3*a* via a worm 2 and a worm wheel 3 mounted on the shaft 3*a*, the worm wheel 3 and the gear 4 constituting a speed reduction mechanism. A crank gear 5 is driven by gear 4 to rotate in a definite direction about a shaft 5*a* and includes a crank pin 5*b* projecting eccentrically with respect to shaft 5*a*. An L shaped crank lever 6 is rotatably mounted on a shaft 6*a*. A longer leg of the crank lever 6 is formed with a slot 6*b* to slidably receive the crank pin 5*b*; on the other hand a shorter leg of crank lever 6 is provided with a crank groove 6*c* with one end opened for slidably receiving a pin 14*a*. The pin 14*a* is secured to one end of an elbow 14 of the fin swinging angle control mechanism to be described later. When the crank gear 5 rotates, as the crank pin 5*b* rotates while sliding along the crank groove 6*b*, the crank lever 6 is swung about shaft 6*a*. Consequently, the pin 14*a* slidably received in crank groove 6*c* would be subjected to a force tending to rotate the pin 14*a* about the shaft 6*a* of the crank lever 6.

The pin 14*a* is also loosely received in a groove 7*b* formed through a link gear 7 rotatable about a shaft 7*a*. Thus the pin 14*a* is received in both grooves 6*c* and 7*b* at a point at which grooves 6*c* and 7*b* cross each other. Consequently, the link gear 7 is rotated about shaft 7*a* by a circumferential force applied to shaft 14*a* by the arcuate movement of the shorter leg of the crank lever 6.

The fin swinging angle control apparatus comprises a plurality of fins 8–11 which have substantially the same rectangular shape. The fins 8–11 are integrally provided with upper fin axis pins 8*a*, 9*a*, 10*a* and 11*a*, and lower fin axis pins 8*b*, 9*b*, 10*b* and 11*b* at the central portions of upper and lower surfaces of respective fins. These fin axis pins are rotatably journalled by an upper plate 52 and a lower plate 51 of the apparatus. (see FIG. 2) All fins are disposed in parallel and one end 8*c*, 9*c*, 10*c* and 11*c* of each of the fins 8, 9, 10 and 11 is rotatably connected to a link 13.

The fin 8 is driven by the rotational motion of the link gear 7. As the fin 8 swings about its upper and lower fin axis pins 8*a* and 8*b*, other fins interconnected by link 13 are caused to swing in parallel about their upper and lower fin axis pins. The link gear 7 meshes with a fin gear 12 which is secured to the upper pin 8*a* of fin 8 so that as the link gear 7 swings, the fin 8 is swung over a predetermined angle through the fin gear 12 and fin axis pin 8*a*.

The members having reference numeral 32, 33 will be described later in connection with the mechanism for adjusting the center of swinging angle of the fin.

The elbow 14 having a pin 14*a* at one end, an L shaped arm 15, an adjusting dial 16, a dial shaft 17, an eccentric cam 18 and a spring 30 constitute the fin swinging angle adjusting mechanism which adjusts the swinging angle of the fins by changing the position of pin 14*a*.

The pin 14*a* is secured to one end of the elbow 14, while the other end thereof is rotatably connected to the L shaped arm 15 through a pivot joint 14*b*. The L shaped arm 15 is rotated about a stationary pin 15*a*. To the longer arm of the L shaped arm 15 is connected one end of a spring 30 with other end held stationary, while the shorter arm of the L shaped arm 15 is maintained in contact with an eccentric cam 18. The adjusting dial 16 and the eccentric cam 18 are secured to the opposite ends of dial shaft 17 which is journalled by a bearing, not shown. In the fin swinging angle adjusting mechanism described above, the cam 18 is rotated when the dial 16 is rotated. Since the shorter arm of the L shaped arm 15 is urged against the eccentric cam 18 by the force of spring 30, the L shaped arm 15 would rotate about shaft 15*a* according to the peripheral configuration of the eccentric cam 18.

Swinging and swinging angle adjustment of the fins are effected as follows by the fin swinging angle control apparatus. Thus, as motor 1 is driven, worm wheel 3 is rotated by worm 2 so as to rotate the reduction gear 4 at a low speed and in a definite direction. Further, as the reduction gear 4 rotates, the crank gear 5 meshing therewith begins to rotate together with crank pin 5*b*. By the rotation of the crank pin 5*b*, the crank lever 6 begins to swing about stationary shaft 6*a* through crank pin 5*b* and slot 6*b*. As the crank lever 6 is swung, the pin 14*a* loosely received in crank groove 6*c* is also swung so as to swing the link gear 7 about stationary shaft 7*a*. Then the fin gear 12 follows this swinging motion, thus swinging the fin 8 about shaft 8*a* over a predetermined angle. As one end 9*c*, 10*c* and 11*c* of each of the other fins 9, 10 and 11 is connected to fin 8 through link 13, the fins 9, 10 and 11 are swung in synchronism with fin 8.

Figure 2A:
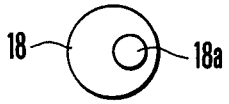
FIGS. 2A, 2B and 2C show different cam shapes.
Figure 2B:
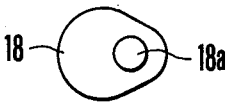
Figure 2C:
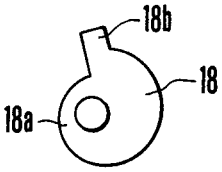

When the fins 8–11 are swung, the direction of air supplied from a blower or fan, not shown, can be changed. Thus, the range of the direction of air blasted is determined by the swinging angles of the fins 8–11.

Where it is desirable to change the range of direction of the blasted air depending upon the health condition of the driver, for example, such change can readily be done by rotating the adjusting dial 16. Thus, as the adjusting dial 16 is rotated, the eccentric cam 18 is rotated. As has been pointed out before, the L shaped arm 15 is caused to stop at an angle of rotation corresponding to the stop position of the cam 18 by the force of spring 30. Suppose now that the L shaped arm 15 is rotated in the counterclockwise direction in FIG. 1 against the force of spring 30 by rotating adjusting dial 16. Then the pivot pin 14*b* would also be rotated in the counterclockwise direction about shaft 15*a*. Then the elbow 14 rotatably connected to the outer end of the L shaped arm 15 is raised upward as viewed in FIG. 1. Consequently, the pin 14*a* provided on one end of the elbow 14 slides through grooves 6*c* and 7*b* respectively provided for the crank lever 6 and the link gear 7 toward the upper side as viewed in FIG. 1. This upward movement of pin 14*a* changes the ratio (lever ratio) between the distance between the stationary shaft 6*a* of the crank lever 6 and pin 14*a* and the distance between the stationary shaft 7*a* of the link gear 7 and pin 14*a*, so that the angle of swing of the link gear 7 varies even when the angle of swing of the crank lever 6 is constant. In this case the angle of swing of the link gear 7 decreases. Consequently, the fin gear 12 moves to follow the reciprocating motion of the link gear 7 of a small degree of swing so as to make small the angle of swing of the fin 8 about its shaft 8*a*. Conversely, to increase the angle of swing of the fin 8, the pin 14*a* is moved downwardly as viewed in FIG. 1 by rotating the adjusting dial 16. In this manner, by rotating the adjusting dial 16, the degree of swing of the fins 8–11 can readily be varied, thus varying the range of the blasted air. The eccentric cam 18 utilized in this embodiment may have a configuration as shown in FIGS. 2A–2C. When the configuration shown in FIG. 2C is used, and the cam 18 is rotated by adjusting dial 16 a projection 18*b* of the cam 18 would collide against the L shaped arm 15, thus limiting the range of adjustment of the angle of swinging of the fins 8–11.

Figure 3A:
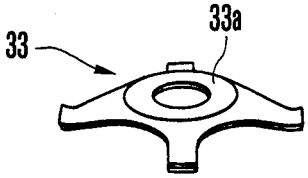
FIG. 3A is a perspective view of spring washer in FIG. 3.
Figure 3:
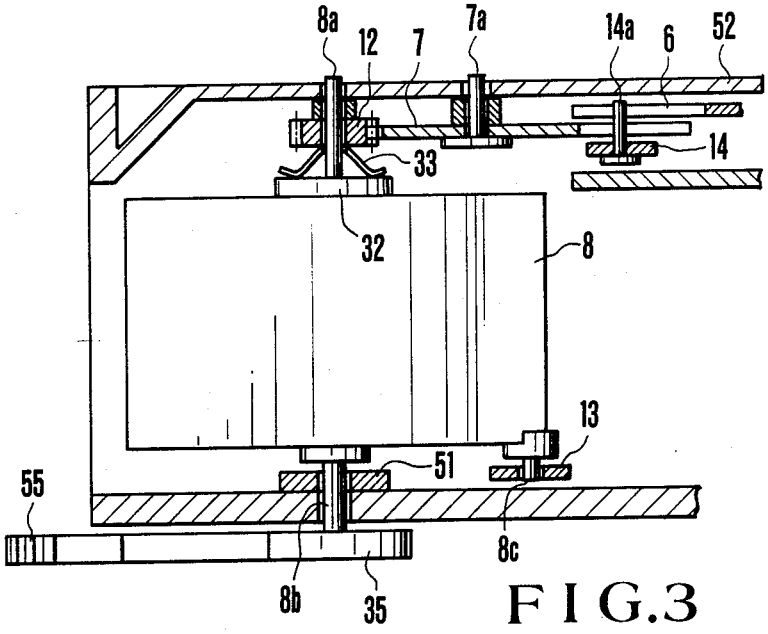
FIG. 3 is a cross sectional view taken along line III—III in FIG. 2 showing one example of a mechanism for adjusting the center of swinging of the fins.

A fin swinging center adjusting mechanism for adjusting the center of the swinging angle of the fins 8–11 will now be described. FIGS. 2 and 3 illustrate one example of the fin swinging angle center adjusting mechanism provided for the fin 8. FIG. 3 is a cross sectional view taken along line III—III in FIG. 2, showing a side view of fin 8 and the swinging angle center adjusting mechanism.

As shown in FIGS. 2 and 3, a circular plate 32 is secured to the upper end of the fin 8 so that when the fin 8 rotates, the circular plate 32 rotates.

A spring washer 33 is clamped between the fin gear 12 and the circular plate 32. As shown in FIG. 3A, the spring washer 33 has a circular portion 33*a* at the center thereof and a plurality of curved elastic feet extending downwardly. Thus, the spring washer 33 has an elasticity resisting against the pressure applied thereto from upper and lower sides. The lower ends of respective feet of the spring washer 33 are secured to the upper surface of the circular plate 32 so that the spring washer 33 rotates together with the fin 8. The upper circular portion 33*a* of the spring washer 33 is urged against the lower surface of the fin gear 12 under a suitable pressure. This pressure is set such that as the link gear 7 is rotated by motor 1 to rotate the fin gear 12, the friction between the lower surface of the fin gear 12 and the circular portion 33*a* of the spring washer 33 rotates the spring washer 33 and hence the fin 8, and that the fin 8 can be manually rotated when the motor 1 is rotated or stopped regardless of the friction between the fin gear 12 and the spring washer 33.

A lower fin axis pin 8*b* secured to the lower center of the fin 8 extends through the lower plate 51 acting as a bearing. A plate 35 which is integrally constructed with a manually operated lever 55 is secured to the lower end of the pin fin axis 8*b*. When the lever 55 is rotated manually, the fin 8 can be rotated. At this time, the rotary motion of lever 55 applied to fin 8 would not be transmitted to the link gear 7 due to a slip mechanism constituted by the fin gear 12, circular plate 32 and the spring washer 33. For this reason, fin 8 and other fins can be directed in any direction independently of the driving of the fin 8 caused by the link gear 7, thereby enabling the adjustment of the center of the swinging angle of the fins.

Figure 4:
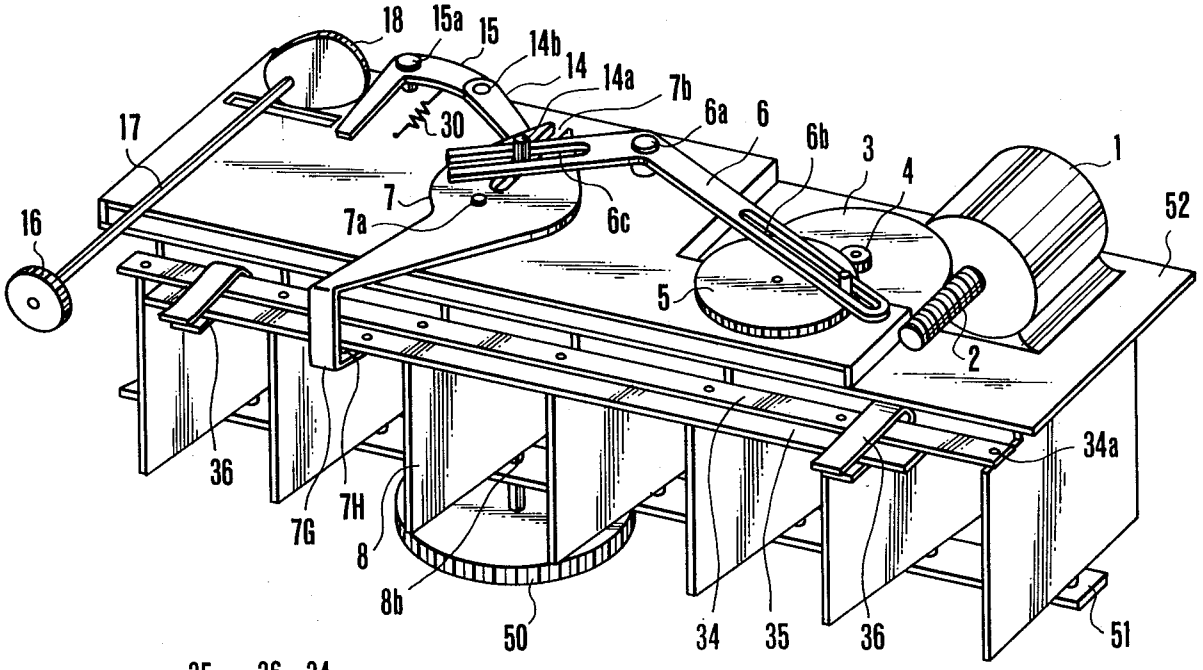
FIG. 4 is a perspective view showing another example of the mechanism for adjusting the center of the swinging angle of the fins.
Figure 5:
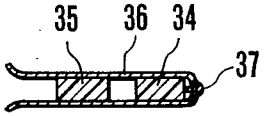
FIG. 5 is a sectional view showing a spring clip used in FIG. 5.

FIG. 4 illustrates another example of the fin swinging angle center adjusting mechanism in which a spring clip 36 made of a U shaped leaf spring and bars 34 and 35 constitute a slip mechanism. One horizontal end of respective fins 8, 9, 10, 11 is connected to bar 34 by pins 34*a* so that the longitudinal movement of the bar 34 causes respective fins to swing. The spring clip 36 is secured to the bar 34, and the spring clip 36 clamps bar 35 by its compressive force. The bar 35 is connected to the link gear 7 through a U shaped arm 7G so that rotation of the link gear 7 moves the bar 35 in the longitudinal direction. The friction between the inner surface of spring clip 36 and the periphery of bar 35 converts the longitudinal motion of bar 35 effected by motor 1 into the longitudinal motion of bar 34. However, the spring clip 36 is constructed such that manual longitudinal motion of bar 35, that is the manual swinging of the fin 8 would not be transmitted to bar 35. FIG. 5 shows a sectional view of the slip mechanism wherein the spring clip 36 clamps rectangular bars 34 and 35.

With the fin swinging angle adjusting mechanism shown in FIG. 4, as the motor 1 rotates to rotate the link gear 7 over a swinging angle set by the fin swinging angle adjusting mechanism 14 (including pin 14*a*), 15, 16, 17 and 18, this motion is converted into the longitudinal motion of bar 35.

As the bar 35 moves, the bar 34 is also moved by the friction created by the compressive force of spring 36, thus swinging the fin 8. A pin hole 7H for interconnecting arm 7G and bar 35 is elongated by taking into consideration the difference in the radii of rotation when the positions of the axes of the link gear 7 and the fin are different.

When knob 50 is manually rotated, the fin axis pin 8*b* rotates the fin 8 with the result that the bar 34 is moved in the longitudinal direction. But the bar 35 does not move owing to slippage at the spring clip 36. Thus, it is possible to change the center of the swinging angle of the fins 8–11 regardless of the rotation of the link gear 7 caused by motor 1 and the link mechanism.

In FIG. 4, the spring clip 36 clamps both bars 34 and 35, but the bar 34 may be positioned on the outside of the spring clip 36.

Figure 6:
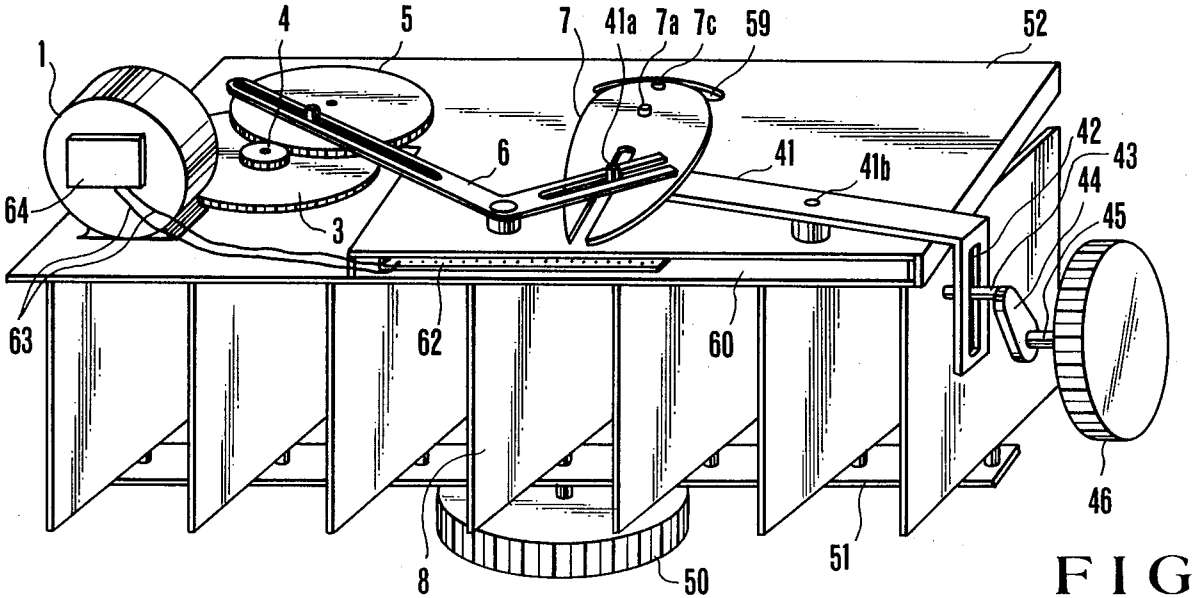
FIG. 6 is a perspective view showing still another embodiment of the control apparatus according to this invention and FIG. 7 is a plan view showing yet another embodiment of the control apparatus embodying the invention.

It should be understood that the connection between the link gear 7 and the bar 35 is not limited to that shown in FIG. 4 but as shown in FIG. 6 an arcuate groove 59 having a center at the axis of the rotating shaft 7*a* of the link gear 7 may be provided for the upper plate 52 for receiving a connecting rod 7*c* interconnecting link gear 7 and bar 35, so as to move the connecting rod 7*c* along the groove 59 when the link gear 7 rotates.

Members 41–46 shown in FIG. 6 constitute another example of the swinging angle adjusting mechanism. As shown, lever 41 is rotatable about stationary shaft 41*a*, and a pin 41*b* similar to pin 14*a* shown in the foregoing embodiment is projected from the inner end of lever 41. The outer end of lever 41 is bent at right angles and a slot 42 is formed through the bent end. The slot 42 receives a crank pin 43 secured to the outer end of a crank arm 44. The inner end of crank arm 44 is secured to a crank shaft 45 journalled by a stationary bearing, not shown. A knob 46 is secured to the outer end of crank shaft 45. The swinging angle adjusting mechanism described in FIG. 6 operates as follows. When knob 46 is rotated in the counterclockwise direction, crank arm 44 is rotated also in the same direction together with crank shaft 45. As a result, crank pin 43 moves to the left to press the lefthand edge of the slot 42. Consequently, lever 41 is rotated in the clockwise direction about shaft 41*b*, thus moving pin 41*a* toward the shaft 7*a* of the link gear 7. When the knob 46 is rotated in the opposite direction, pin 41*a* is moved in the opposite direction.

The construction of crank pin 43 engaging groove 42 can be modified variously. Although FIG. 6 shows a simple construction in which knob 46 is mounted on one side of the fin swinging control apparatus, the knob 46 can be mounted on the front side of the apparatus by facing the slot 42 to front side. Then lever 41 should be constituted by a plurality of pivotally connected levers instead of a single straight lever 41.

A board 62 containing a control circuit is secured to a shelf 60 at the upper portion of the plate 52. The motor 1 is connected to the control circuit through connecting conductors 63 and a connection box 64 mounted on the motor 1.

Figure 7:
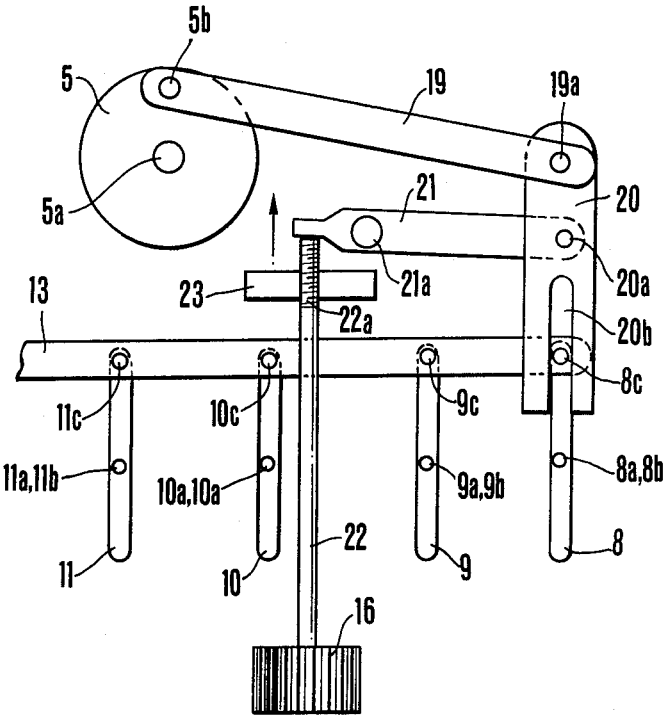

FIG. 7 shows a modified embodiment of the fin swinging angle control apparatus comprising a crank link 19 pivotally connected to a crank pin 5*b*, a fin link 20 pivotally connected to crank link 19 through a pivot pin 19*a* and an arm 21 rotatable about a stationary shaft 21*a* and pivotally connected to link 20 through a pivot pin 20*a*.

An open groove 20*b* is formed at the lower end of fin link 20 for loosely receiving a pivot pin 8*c* for moving the fin 8. The left end of arm 21 is secured to the upper end of a dial shaft 22 with its threaded portion 22*a* threaded into a support 23.

The fin swinging angle control apparatus shown in FIG. 7 operates as follows. More particularly, as the crank pin 5*b* begins to rotate due to the rotation of crank gear 5, the crank link 19 swings fin link 20 about pin 20*a*. The swinging motion of the fin link 20 swings the fin 8 about fin axis pin 8*a* via connection of pivot pin 8*c* and slot 20*b*. Consequently, other fins 9, 10 and 11 are swung over the same angle about their fin axis pins 9*a*–11*a* via link 13. When the adjusting dial 16 is rotated to move upwardly its shaft 22, the arm 21 is rotated in the clockwise direction over an angle proportional to the angle of rotation of the adjusting dial 16, so as to move downwardly pin 20*a* connecting arm 21 to the fin link 20, thus changing the position of the pivot pin 8*c* of fin 8 received in the groove 20*b* of the link 20. In this case the pivot pin 8*c* is positioned at the inner end of the groove 20*b*. In this manner, the movement of pin 20*a* changes the distance between pin 20*a* and pivot pin 8*c* of the fin 8, so that the angle of swinging of fin 8 can be varied even though the angle of swing of the fin link 20 is not changed. In this case, the swinging angle of the fin 8 decreases. For increasing the angle of swing of fin 8 the adjusting dial 16 is rotated in the opposite direction to raise the pin 20*a*.

While in this embodiment adjusting dial 16 was used as the swinging angle adjusting means, this means is not so limited an adjusting dial and an adjusting lever or the like can be use. Furthermore, the above described fin swinging angle adjusting means and fin swinging angle center adjusting means are not limited to manual operated means, but may be automatically operated. In the embodiment of an automatic fin swinging angle adjusting mechanism, the dial 16 in FIG. 2 and knob 46 in FIG. 6 are replaced by a microcomputer controlled actuator, for example a pulse motor.

Also, in the embodiment of the automatic fin swinging angle center adjusting mechanism, the lever 55 in FIG. 2 and knob 50 in FIG. 5 are replaced by another microcomputer controlled pulse motor.

These pulse motors are controlled by a microcomputer which includes a predetermined program in memory.

A plurality of condition sensors for detecting conditions, for example, temperature distribution are disposed in the vehicle and supply the data signal to the microcomputer.

The microcomputer calculates the optimum values of the swinging angle and the center of swinging angle and supplies to the pulse motors the signals representing the required rotation angles of the pulse motors.

One pulse motor rotates the shaft 17 in FIG. 2 or shaft 45 in FIG. 6 with the result of changing the swinging angle of fin 8, and the other pulse motor rotates the fin axis pin 8*b* of fin 8 with the result of changing the center of swinging angle of fin 8, in the same manner as the manual operation above described.

Furthermore, the swinging angle control apparatus of this invention can be applied to other articles, for example aircraft, motor boat etc. other than motor cars.

As above described, according to the fin swinging angle control apparatus of this invention, not only the angle of swing of the fin can be adjusted with the swinging angle adjusting mechanism, but also the center of the fin swinging angle can be adjusted with the fin swinging angle center adjusting mechanism. Accordingly it is possible to supply optimum cool air or warm air commensurate with the conditions in the car.

What is claimed is:

1. An apparatus for controlling movement of a louver fin comprising:

a fin rotatably pivoted on a shaft;

means for reversibly rotating said fin about said shaft within a predetermined angular range;

means for continuously varying the magnitude of said angular range in accordance with a desired blow range of air emitted from said louver; and means for continuously varying the center of rotation of said angular range in accordance with a desired direction of air emitted from said louver;

said angular range varying means and said angular range center of rotation varying means being adjustable independently from each other.

2. The control apparatus according to claim 1 wherein said fin rotating means comprises motion converting means which converts a motion of a drive source into the reversible rotation of said fin at a ratio of rotation angles, said angular range varying means comprises means for continuously changing said ratio of said motion converting means, and said means for continuously varying the center of rotation of said angular range is adjustable to rotate said fin irrespective of said fin rotating means and said angular range varying means.

3. The apparatus according to claim 2 wherein said motion converting means comprises a first link mechanism which is caused to make an arcuate motion by said drive source, and a second link mechanism causing said fin to make an arcuate motion, and said ratio changing means changes the ratio between angles of said arcuate motions of said first and second link mechanisms.

4. The control mechanism according to claim 3 wherein said ratio changing means comprises a sliding member which commonly and slidably engages said first and second link mechanisms so as to change said ratio, and wherein said angular range varying means is adjustable to change a position of said sliding member.

5. The control apparatus according to claim 2 wherein said means for varying the center of rotation of said angular range comprises a slip mechanism between said motion converting means and said fin, said slip mechanism being capable of driving said fin by said motion converting means but incapable of moving said motion converting means by moving said fin.

6. The control apparatus according to claim 1 wherein said angular range varying means and said means for varying the center of rotation of said angular range comprise a plurality of condition sensors for detecting a condition, a controller for receiving from said plurality of condition sensors respective output signals to output a signal representing an optimum angular range and an optimum center of rotation of said angular range, and motor means respectively provided responsive to the signal from said controller for driving said angular range varying means and said means for varying the center of rotation of said angular means.

* * * * *